US007232288B2

(12) United States Patent
Tibban

(10) Patent No.: US 7,232,288 B2
(45) Date of Patent: Jun. 19, 2007

(54) HYDRAULIC SUBMERSIBLE MUD PUMP

(76) Inventor: James Tibban, 22371 Sioux Rd., Apple Valley, CA (US) 92308

( * ) Notice: Subject to any disclaimer, the term of this patent is extended or adjusted under 35 U.S.C. 154(b) by 224 days.

(21) Appl. No.: 11/047,536

(22) Filed: Jan. 31, 2005

(65) Prior Publication Data

US 2006/0182627 A1 Aug. 17, 2006

(51) Int. Cl.
*F04D 29/18* (2006.01)
*F04D 29/42* (2006.01)

(52) U.S. Cl. ..... 415/169.1; 415/213.1; 415/206; 415/173.1; 416/185; 416/198 R; 416/244 R

(58) Field of Classification Search ..... 415/213.1, 415/169.1, 206, 173.1; 416/185, 224 R, 416/198 R; 417/423.3, 423.15, 424.1
See application file for complete search history.

(56) References Cited

U.S. PATENT DOCUMENTS 3,230,890 A 1/1966 Yokota et al.
3,397,647 A 8/1968 Daniel
3,779,670 A * 12/1973 Crisafulli ..... 417/231
4,138,202 A 2/1979 Eller
4,149,603 A 4/1979 Arnold
4,269,566 A 5/1981 Spruiell
4,541,779 A 9/1985 Birdwell
4,776,758 A * 10/1988 Gullichsen ..... 415/169.1
4,932,837 A * 6/1990 Rymal ..... 415/206
5,306,124 A 4/1994 Back
5,413,462 A * 5/1995 Alberni ..... 415/169.1
5,613,845 A 3/1997 Moon
5,616,009 A 4/1997 Birdwell

FOREIGN PATENT DOCUMENTS

CA 1.189.387 6/1985
GB 530.058 12/1940
RU 2.196.253 1/2003

* cited by examiner

*Primary Examiner*—Ninh H. Nguyen
(74) *Attorney, Agent, or Firm*—Michael I Kroll

(57) ABSTRACT

Apparatus 10 discloses a submersible hydraulic powered pump for removing matter such as liquid, abrasive particulate, slurries or mixtures 12, from a sump or container. The pump has a housing 14 with an integral stand 16 projecting therefrom comprised of a plurality of legs extending to a base plate that will keep the pump spaced away from the ground and gauge the size of matter 56 allowed to enter the pump. Positioned within the housing base is an ingress aperture serving as the intake 50 for flowable matter into a chamber having an impeller assembly 52 driven by a hydraulically powered motor 18. The impeller assembly 52 comprises a plurality of perforated plates and an impeller plate 38 that allows for the release of trapped air through the impeller assembly's apertures at 46 to prevent the buildup of air and unwanted pressure gaps within the pumping lines also known as "air lock." Additionally, the impeller plate 38 and impeller blades have an increased clearance 60 from the sides 58 of the housing 14 to prevent jamming of the impeller due to large particulate matter becoming lodged therebetween during rotation and also to more efficiently induce centrifugal motion about the drawn matter contained in the housing.

8 Claims, 8 Drawing Sheets

HYDRAULIC SUBMERSIBLE MUD PUMP

BACKGROUND OF THE INVENTION

1. Field of the Invention

The present invention relates generally to pumps and, more specifically, to a submersible hydraulic powered pump for removing matter such as liquid, abrasive particulate, slurries or mixtures, from a sump or container.

The pump has a housing with an integral stand projecting therefrom comprised of a plurality of legs extending to a base plate that will keep the pump spaced away from the ground and gauge the size of matter allowed to enter the pump. Positioned within the housing base is an ingress aperture serving as the intake for flowable matter into a chamber having an impeller assembly driven by a hydraulically powered motor.

One of the unique features of the pump are a number of apertures placed in the impeller base plate to allow trapped air to escape, thus preventing the typical air block that effects the output flow rate if not preventing any output from occurring. This feature allows the pump to run dry, which in itself is a labor saving design in conditions where the sump source material is sporadically provided, currently requiring stopping and restarting the pump or the need for incorporating some sensor logic to detect pumpable source material to engage and disengage the pump.

As stated, the impeller assembly consists of a plurality of perforated plates and an impeller that allows for the release of trapped air through the impeller assembly's apertures to prevent the buildup of air and unwanted pressure gaps within the pumping lines also known as "air lock".

Additionally, the impeller plate and impeller blades have an increased clearance from the sides of the housing to prevent jamming of the impeller due to large particulate matter becoming lodged therebetween during rotation and also to more efficiently induce centrifugal motion about the drawn matter contained in the housing.

Another advantage of the present invention is the placement of the egress port transverse to the pump rotation, commonly referred to as a centrifugal pump where the slurry is ejected from the side of the pump housing, which in combination with the creation of a gap between the housing ingress port and the impeller blades allows for larger particulate matter to be directed to the output port without engaging the impeller blade.

2. Description of the Prior Art

There are other pumps designed for moving fluid material. Typical of these is U.S. Pat. No. 3,230,890 issued to Yokota, et al on Nov. 15, 1963.

Another patent was issued to Daniel on Aug. 20, 1968 as U.S. Pat. No. 3,397,647. Yet another U.S. Pat. No. 4,138,202 was issued to Eller on Feb. 6, 1979 and still yet another was issued on Apr. 17, 1979 to Arnold as U.S. Pat. No. 4,149,603.

Another patent was issued to Spruiell on May 26, 1981 as U.S. Pat. No. 4,269,566. Yet another U.S. Pat. No. 4,541,779 was issued to Birdwell on Sep. 17, 1985. Another was issued to Back on Apr. 26, 1994 as U.S. Pat. No. 5,306,124 and still yet another was issued on Mar. 25, 1997 to Moon as U.S. Pat. No. 5,613,845.

Another patent was issued to Birdwell on Apr. 1, 1997 as U.S. Pat. No. 5,616,009. Yet another U.K. Patent No. GB530,058 was issued Jackson on Jun. 2, 1939. Another was issued to Futros on Jun. 25, 1985 as Canadian Patent No. CA1,189,387 and still yet another was issued on Oct. 1, 2001 to Gluskin as Russian Patent No. RU 2,196,253C1.

A centrifugal pump assemblage comprising a main pump having a casing, a driving shaft, a main centrifugal impeller mounted on said shaft within a casing, a suction inlet and a discharge outlet communicating with said casing, an auxiliary pump having an auxiliary casing disposed in side-by-side relationship to the main pump casing, a common wall between said main and auxiliary centrifugal impeller, said driving shaft extending through the auxiliary pump casing, said common wall, said auxiliary impeller being mounted on said shaft within said auxiliary pump casing, said common wall having a central suction inlet opening therein providing communication between said main pump casing and said auxiliary pump casing, means on said shaft serving to restrict the cross sectional area of said central suction inlet opening, a discharge outlet from said auxiliary casing communicating with the suction outlet of the main pump casing, whereby dense fluid is discharged from said auxiliary pump casing to the suction inlet of said main pump casing, and a vacuum pump having a suction inlet in communication with said auxiliary pump casing, the pumping capacity of the vacuum pump being such that the vacuum developed thereby is overcome by the pumping action of the auxiliary pump.

A pump convertible to and from floating operation and dry base operation, comprising a float, a support carried by a float, a pump mounted on the support, and means releasably selectively securing the pump to one side of the support for floating operation and to the other side of the support for dry base operation.

The present hydraulic system for driving a submersible pumping unit has an above-ground pump for pumping oil through a hydraulic motor in the submersible pumping unit, and a check valve between the above-ground pump and that hydraulic motor to prevent the reverse flow of oil after the submersible pumping unit is turned off. A pressure regulating valve limits the oil pressure to the hydraulic motor. The inlet flow to the above-ground pump is filtered.

A system and method are disclosed which eliminates the use of a riser pipe in underwater drilling operations. The system includes a mud sump connectable to the top of a submerged wellhead and has a bottom with a mud inlet provided therein and an upwardly extending wall cooperating with the bottom to support a quantity of mud, the sump restricting the water to contact with only the upper surface of the mud as the mud passes upwardly through the mud inlet in the bottom. A hose, separate from the drill string, is used to carry mud to the surface of the water. A pumping means is used to pump mud through the hose in response to the quantity of mud supported within the sump to thereby return the mud to the surface of the water without the use of a riser pipe.

In the pumping of abrasive liquids, particularly drilling mud, the packing and seals of the centrifugal pump are quickly cut out, making replacement and down time a problem. The present invention utilizes the abrasive liquid being pumped to function instead of packing and seals, furthermore, the suction chamber is between the abrasive liquid forming the seal, within the sealing housing, and the primary impeller chamber.

A multicylinder, hydraulic-driven, dual arranged mud pump is disclosed. The preferred embodiment consist of dual mud pumping units arranged to be selectively operated as individual pumps, as two pumps whose output flow is in parallel, or as two pumps whose output flow is in series. Each mud pumping unit is comprised of plural pumping assemblies with each assembly consisting of a pair of separate end to end cylinders, one cylinder being arranged to be driven by a second cylinder with the one cylinder further being arranged to pump mud and the second cylinder being arranged to be reciprocally driven in a sequential manner by pressurized hydraulic fluid. The pressurized hydraulic fluid is supplied to all operating second cylinders from common pressurized fluid source with the pressurized fluid being distributed to and returned from the second cylinder by an independently operated distribution valve, the volume of pressurized fluid flow being employed to synchronize the stroke and control the stroke length of the second cylinder which in turn controls the volume of pumped mud.

A mud pump assembly has a housing having a motor-mounting face directly connected to a standard hydraulic drive motor. The pump housing supports and partially encloses a bearing assembly which supports the pump impeller shaft. A face-type impeller shaft seal is located between the bearing assembly and the impeller. The motor case completes enclosure of the impeller shaft bearing assembly. A motor case drain line is coupled to the mud pump housing for continuous pressure lubrication of the bearing assembly. In one embodiment, case drain fluid is returned from the mud pump housing to the hydraulic fluid reservoir for the hydraulic motor.

The present invention is relating to a circulating pump for pressurizing and circulating fluid in a system such as a boiler. An object of the present invention is to provide a circulating pump with a sub-impeller wherein a separate sub-impeller is provided below an impeller for moderating resistance occurring at the impeller due to pressure difference between an impeller chamber and an inside of the impeller during an operation of a pump so that power loss is prevented during a motor driving and a substance such as mud is prevented from entering a stator can. The circulating pump with a sub-impeller comprises a motor, an impeller and a pump housing. Below the impeller body, a sub-impeller with a plurality of radial blades is provided. The sub-impeller forces out pressurized fluid that has flowed below the impeller back from below the impeller radially while rotating. According to this, pressure difference between an impeller chamber and an inside of the impeller which makes the impeller rise toward a suction ring is reduced. Thus, loss of power consumed for overcoming the pressure difference is also reduced.

A multicylinder, double acting improved mud pump is disclosed. The preferred embodiment incorporates a hydraulic powered piston in a cylinder which connects with a piston rod which, in turn, drives a second piston in a cylinder adapted to pump fluid mud. The first piston is driven by hydraulic oil delivered under pressure to intake manifolds through an independently driven valving apparatus which times the delivery of the hydraulic fluid for the main power stroke and further times the discharge of the hydraulic fluid for the return secondary power stroke, the system being controlled independently of piston action in timing of multiple pistons in multiple cylinders by the valve system. Additionally, an intake valve delivers fluid mud at lower pressure on the intake side of the mud compression piston, and an outlet valve transverses with the piston rod to direct the outlet mud flow. Additionally, a mud piston is provided which defines a first compression chamber for receipt of incoming fluid mud and a second compression chamber for discharge of pressurized fluid mud. Additionally, the outlet flow valve being contained within the confines of the mud piston and additionally the unidirectional flow valve being operatively controlled by the movement of the mud piston driving rod.

Well drilling systems. STEVENS, A. H. (Jackson, Co., B.). Jun. 2, 1939, No. 16333. [Class, 85] A rotary well drilling system comprises a hollow drill string driven by a rotary table and supported by a hoist, a hydraulically actuated mud pump for forcing mud through the drill string, and a motive liquid system including a prime mover driving a pump supplying fluid to drive the mud pump, the mud pump comprising a cylinder containing both motive fluid and mud separated by a piston the opposed pressure faces of which are approximately equal. A steam turbine drives a multi-stage series-parallel centrifugal pump controlled by a cross-over and valves and delivering to pipe from which, through' valve and needle control valve, supply is effected to a Pelton wheel driving the rotary table, through gearing. A hand-controlled balanced piston valve, controls supply from pipe to cylinders of a hydraulic hoist which has a stroke at least as long as a section of drill pipe and supports and feeds the drill string and valve controls supply to drive the mud pump comprising aligned cylinders <SP>1</SP>, and pistons, <SP>1</SP>, connected by a rod motive fluid being alternately admitted to the inner ends of the cylinders while the mud is drawn in and forced out of the outer ends. In another form, the hydraulic hoist is replaced by a two speed rotary draw-works driven by a Pelton wheel or a reversible radial-piston hydraulic motor. Specification 530,050, [Group XXVIII] is referred to.

This invention relates to a reciprocating power drive for a mud pump used in drilling wells, which exhibits no stall points. Power is taken from rods connected to the pistons of an automotive power steering apparatus, the steering gear now functioning merely to time the pistons. Hydraulic power is applied through a steering valve which is driven by a hydraulic motor which reverses direction under control of a pilot valve, which switches automatically when at least one of the pistons is adjacent its maximum or minimum positions.

Oil mechanical engineering; centrifugal multi-stage oil-well pumps for pumping formation fluid. SUBSTANCE: proposed stage of centrifugal oil-well pump includes guide apparatus and impeller mounted in this apparatus. Mounted on lower surface of drive disk are impeller blades; drive disk is provided with holes found between bases of blades. Lower edges of blades are open on side of upper disk of guide apparatus. On periphery part of upper surface of impeller drive disk there is shoulder where additional fins of impeller are located. Holes are made between axis of rotation of impeller and additional fins of impeller. Upper surface of impeller drive disk is located opposite lower disk of guide apparatus of next stage. Shoulder formed on peripheral part of lower surface of lower disk of guide apparatus of said stage is used for fitting lower fins of lower disk of guide apparatus of next stage. EFFECT: enhanced efficiency of crushing gas bubbles and mud inclusions.

While these pumps may be suitable for the purposes for which they were designed, they would not be as suitable for the purposes of the present invention, as hereinafter described.

SUMMARY OF THE PRESENT INVENTION

The present invention discloses a submersible hydraulic powered pump for removing matter such as liquid, abrasive particulate, slurries or mixtures, from a sump or container. The pump has a housing with an integral stand projecting therefrom comprised of a plurality of legs extending to a base plate that will keep the pump spaced away from the ground and gauge the size of matter allowed to enter the pump. Positioned within the housing base is an ingress aperture serving as the intake for flowable matter into a chamber having an impeller assembly driven by a hydraulically powered motor. The impeller assembly comprises a plurality of perforated plates and an impeller plate that allows for the release of trapped air through the impeller assembly's apertures at to prevent the buildup of air and unwanted pressure gaps within the pumping lines also known as "air lock." Additionally, the impeller plate and impeller blades have an increased clearance from the sides of the housing to prevent jamming of the impeller due to large particulate matter becoming lodged therebetween during rotation and also to more efficiently induce centrifugal motion about the drawn matter contained in the housing.

A primary object of the present invention is to provide a hydraulic mud pump that is submersible.

Another object of the present invention is to provide a hydraulic mud pump having multiple perforated plates to allow for expulsion of air.

Yet another object of the present invention is to provide a hydraulic mud pump having a second impeller to protect the seal of the hydraulic motor by pumping solids away from the shaft seal.

Still yet another object of the present invention is to provide a hydraulic mud pump having a stand portion for elevating the inlet from off the ground to prevent clogging by large matter or solid ground.

Another object of the present invention is to provide a hydraulic mud pump having spacing between the impeller assembly and housing wall to prevent jamming by large particulate therebetween.

Additional objects of the present invention will appear as the description proceeds.

The present invention overcomes the shortcomings of the prior art by providing a hydraulic mud pump having a housing with a stand providing an inlet elevated away from the ground whereby fluid material may be drawn to an impeller inside used for imposing centrifugal motion to the drawn material while releasing air that may be built up inside the housing during this process via it's plurality of perforations to prevent pressure gaps that could cause "air lock" throughout the pumping lines. Additionally, the impeller is gapped away from the housing's side to prevent jamming of the impeller by particulate that otherwise would have been lodged therebetween.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
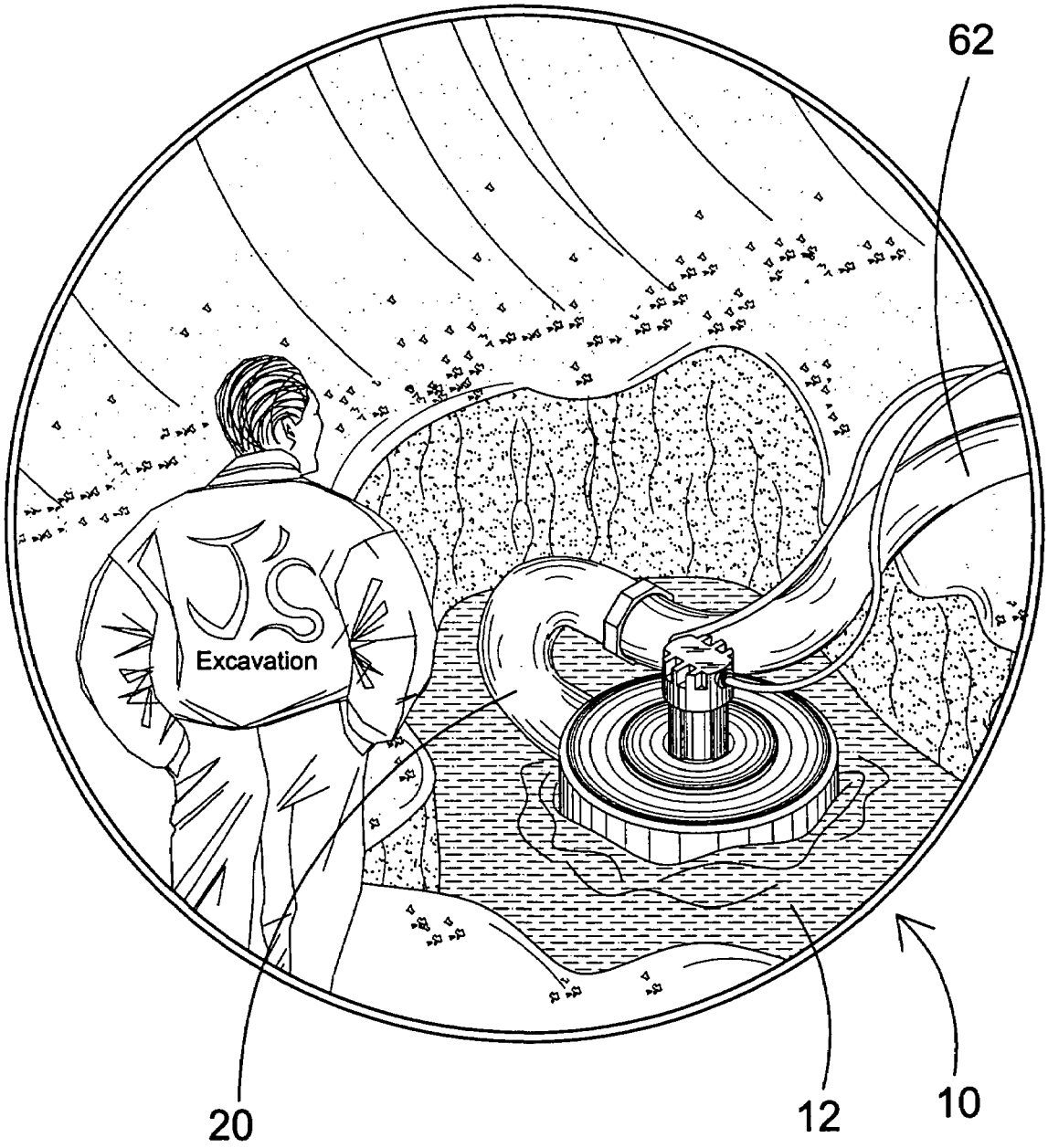
FIG. 1 is an illustrative view of the present invention in use.

With regard to reference numerals used, the following numbering is used throughout the drawings.

10 present invention
12 slurry
14 housing
16 stand
18 motor
20 intake conduit
22 motor mount
24 bolt
26 coupling
28 seal
30 top plate
32 impeller blade
34 perforations
36 openings
35 impeller plate
40 impeller spacer
42 bolt
44 washer
46 arrow
48 impeller outlet
50 impeller inlet
52 impeller assembly
54 drawn air
56 rock
58 wall
60 spacing
62 hose

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the present invention 10 disclosing a hydraulic mud pump for the use of well digging, excavation or the drainage of any sump, having an improved intake portion specially assembled for submersion into a liquid or abrasive slurry 12, outfitted with a perforated impeller that functions to prevent blockage, jamming "air lock" and enhance flow through its application of centrifugal force to the drawn slurry of abrasive particulate. Additionally, the present invention 10 has a stand portion protruding from its bottom and around the inlet to provide ample clearance between the inlet and sump bottom to prevent blockage of the inlet by large pieces of matter. Also shown is hose 62 leading from outlet conduit 20.

Figure 2:
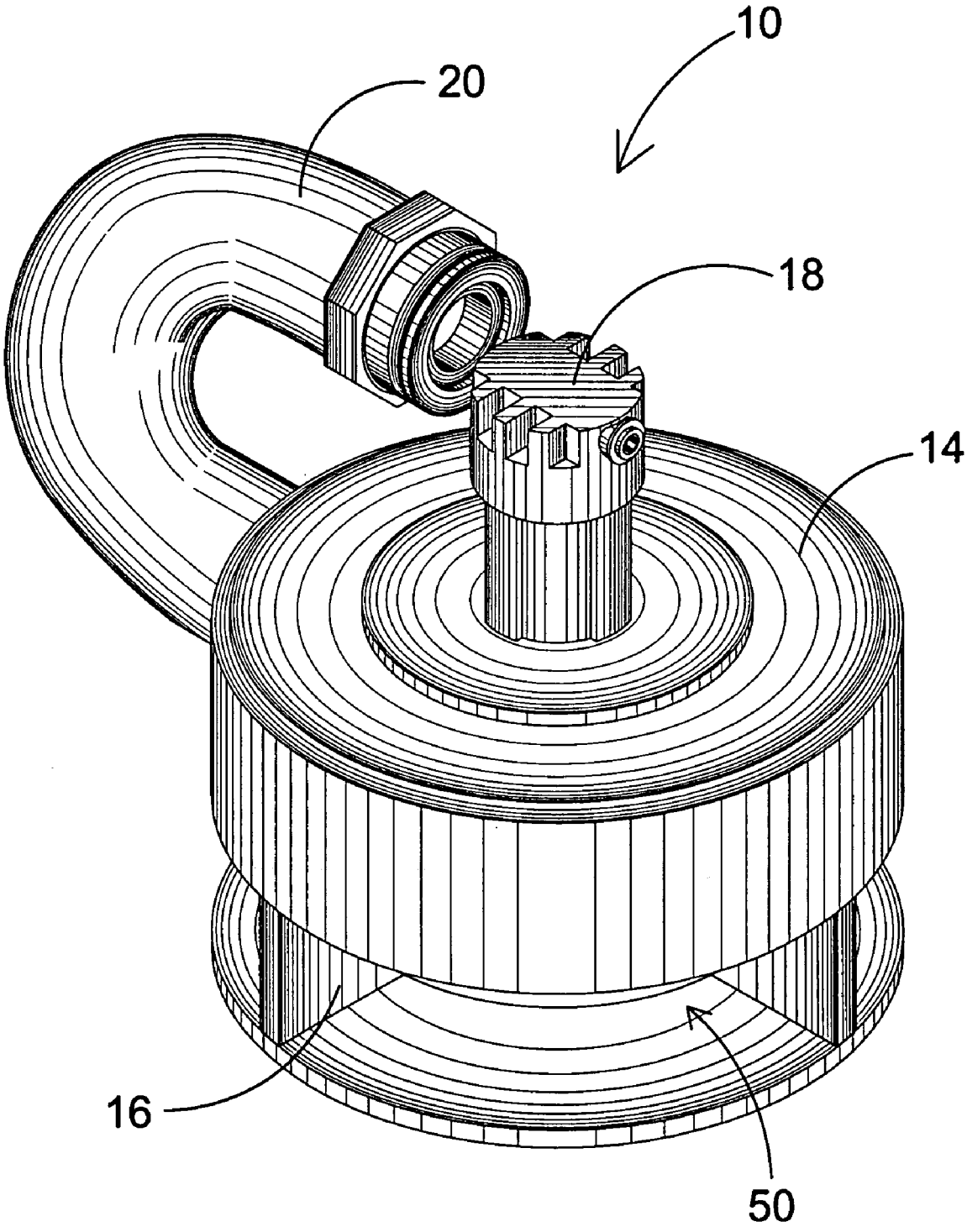
FIG. 2 is a perspective view of the present invention in use.

Turning to FIG. 2, shown therein is a perspective view of the present invention 10. Shown is the present invention 10 having a housing 14 that is integral with an effectively sized protruding stand portion 16 that provides clearance of the present invention's impeller inlet 50 which supplies material to the outlet conduit 20 from a sump's bottom. Additionally shown is the present invention 20 having a hydraulic motor 18 attached to the top of the housing 14 to drive an impeller assembly housed therein.

Figure 3:
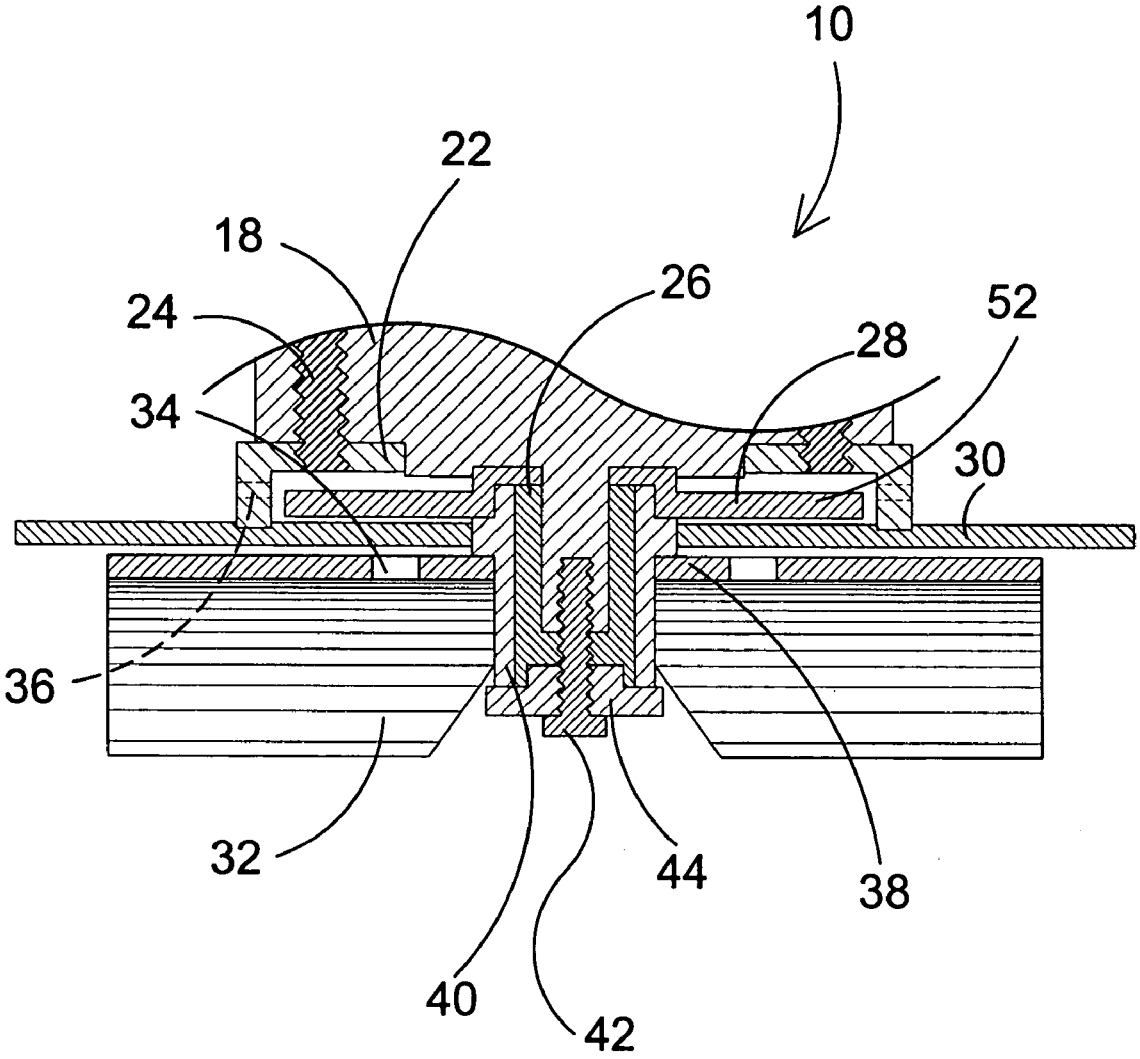
FIG. 3 is a sectional view of the impeller assembly of the present invention.

Turning to FIG. 3, shown therein is a sectional view of the impeller assembly of the present invention 10. Shown is the individual parts of the impeller assembly 52 in their assembled configuration whereby a plurality of perforated plates and spacers cooperate to form a hydraulic driven rotatable seal/connection that allows for the release of trapped air that can collect in the housing during pumping, to prevent jamming or "air lock." Shown are motor 18, motor mount 22, bolt 24, splined coupling 26, seal splasher 28, top plate 30, impeller blade 32, perforations 34, openings 36, impeller plate 38, impeller spacer 40, bolt 42 and washer 44.

Figure 4:
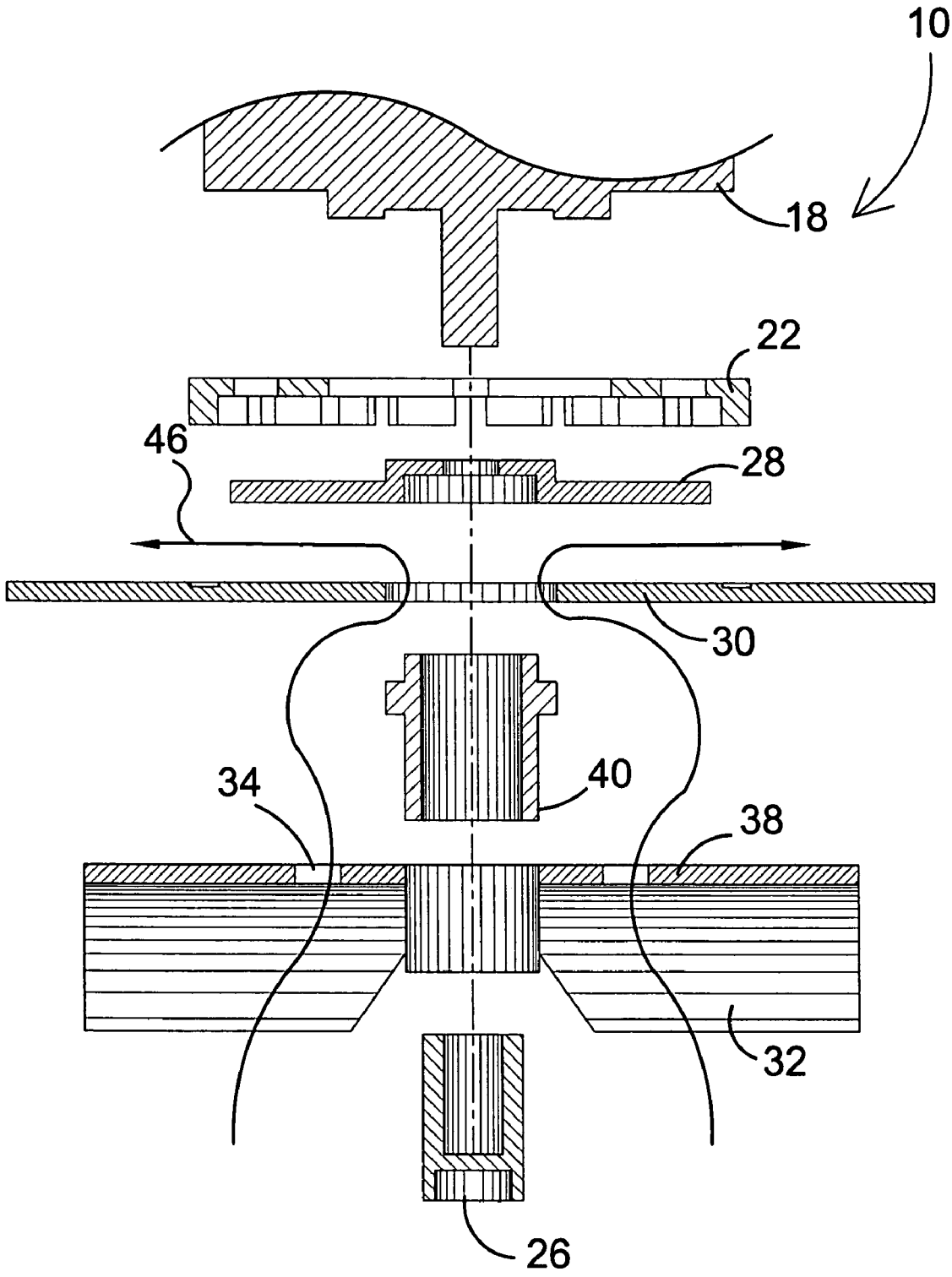
FIG. 4 is a sectional exploded view of the impeller assembly of the present invention.

Turning to FIG. 4, shown therein is a sectional exploded view of the impeller assembly of the present invention 10. Shown is the individual parts of the impeller assembly exploded into their individual parts, including a plurality of perforated plates and spacers that cooperate to form a hydraulically driven rotatable seal/connection that allows for the release of trapped air that can collect in the housing during pumping, to effectively prevent jamming or an "air lock" occurrence. Shown are previously disclosed elements and the direction of air flow shown by arrow 46.

Figure 5:
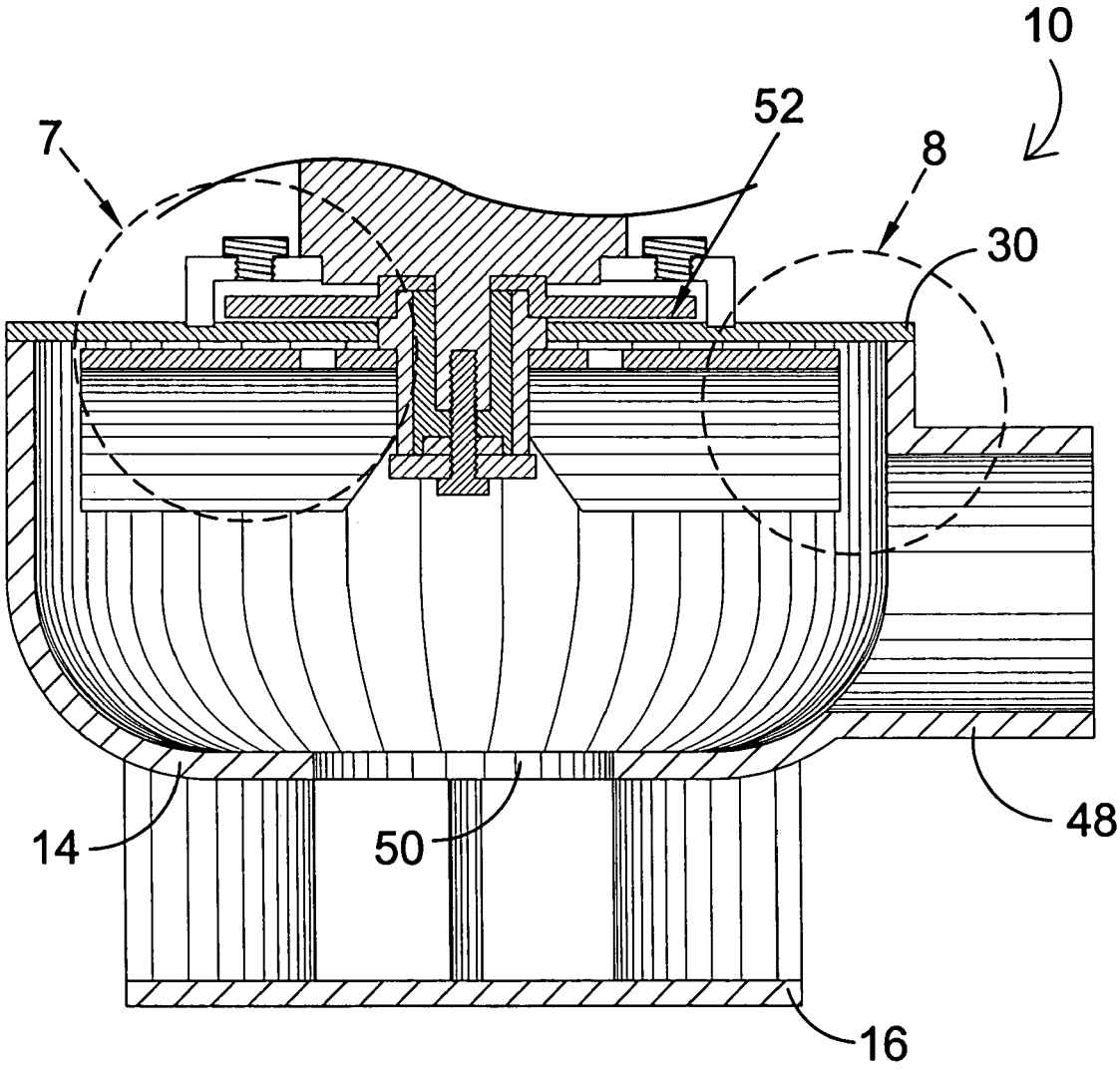
FIG. 5 is a sectional view of the present invention.

Turning to FIG. 5, shown therein is a sectional view of the present invention 10. Shown is the present invention 10 having a hollow housing 14 to direct suction current generated by the impeller assembly 52 through the outlet 48. Additionally shown is clearance to the inlet 50 provided by the structure of the housing's stand portion 16. Also shown is top plate 30.

Figure 6:
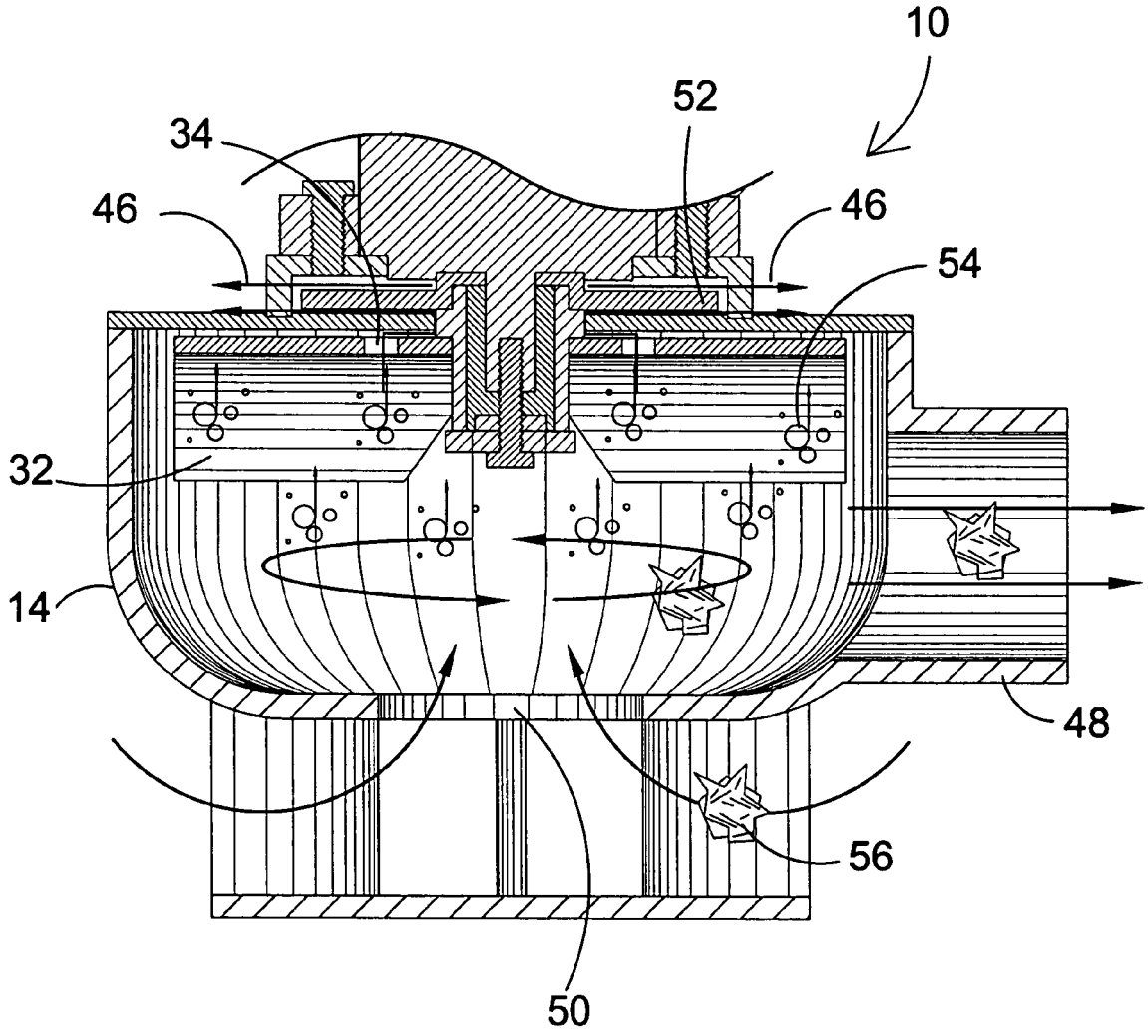
FIG. 6 is a sectional view of the present invention.

Turning to FIG. 6, shown therein is a sectional view of the present invention 10. Shown is the path taken by the liquid or slurry of abrasive particulate drawn by the present invention. The drawn matter, e.g., rock 56, is pulled through the raised inlet 50, then into the housing 14, where it is then agitated and circulated into the outlet 48 via centripetal force applied via the impeller assembly 52 with blades 32. Additionally shown is the release of drawn air 54 into the housing 14 and the directed expulsion of the air at 46 through the perforations 34 made through the impeller assembly 52.

Figure 7:
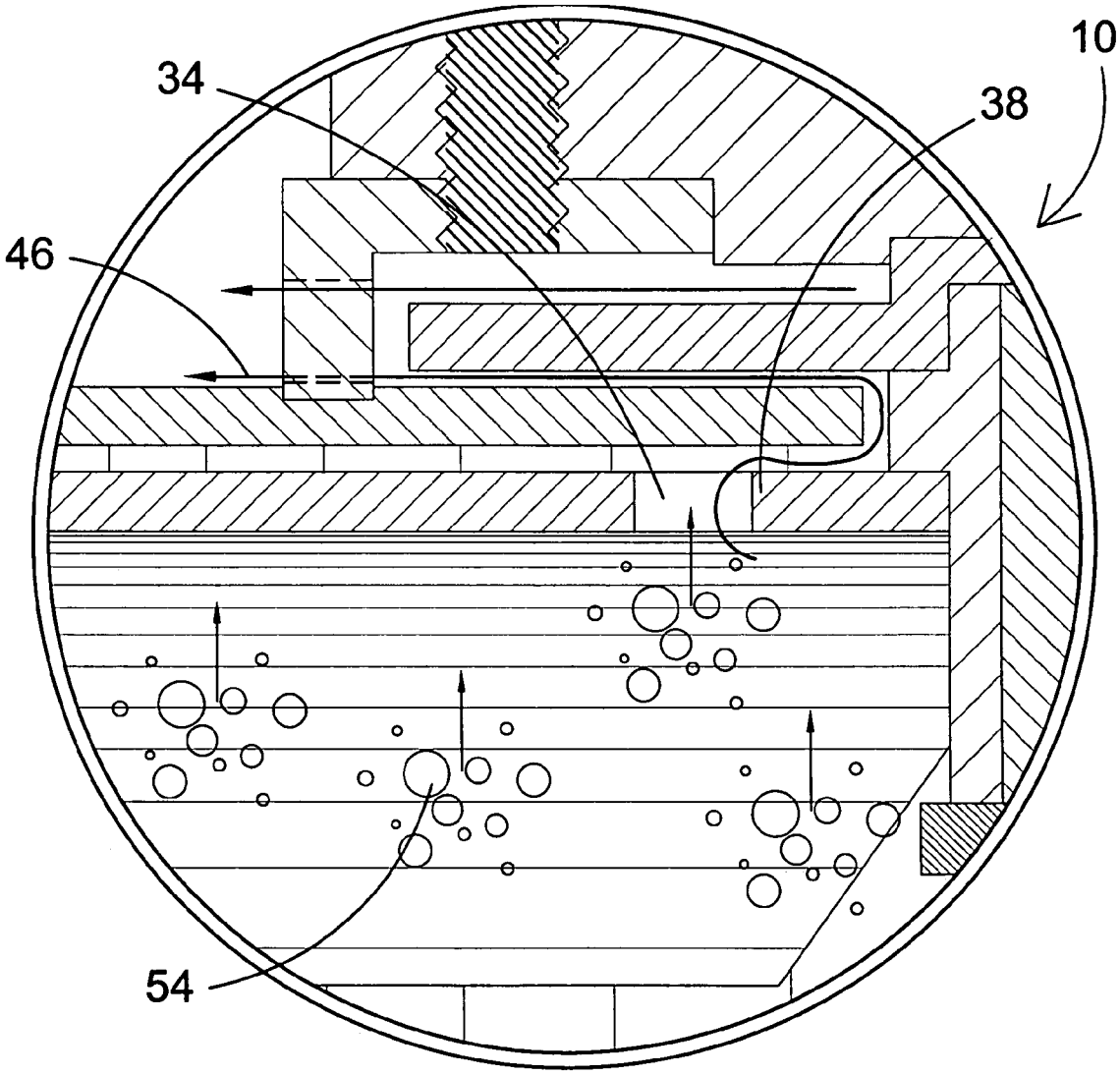
FIG. 7 is a detailed sectional view of the present invention.

Turning to FIG. 7, shown therein is a detailed sectional view of the present invention 10. Shown is the present invention 10 having a plurality of perforations 34 made into the various plates comprising the impeller assembly to allow the present invention to expel unwanted drawn air 54 out the top at 46 of the present invention while in operation, to prevent the building up of a pressure gap inside the housing that would other wise cause jamming or "air lock" of the pump. Also shown is impeller plate 38.

Figure 8:
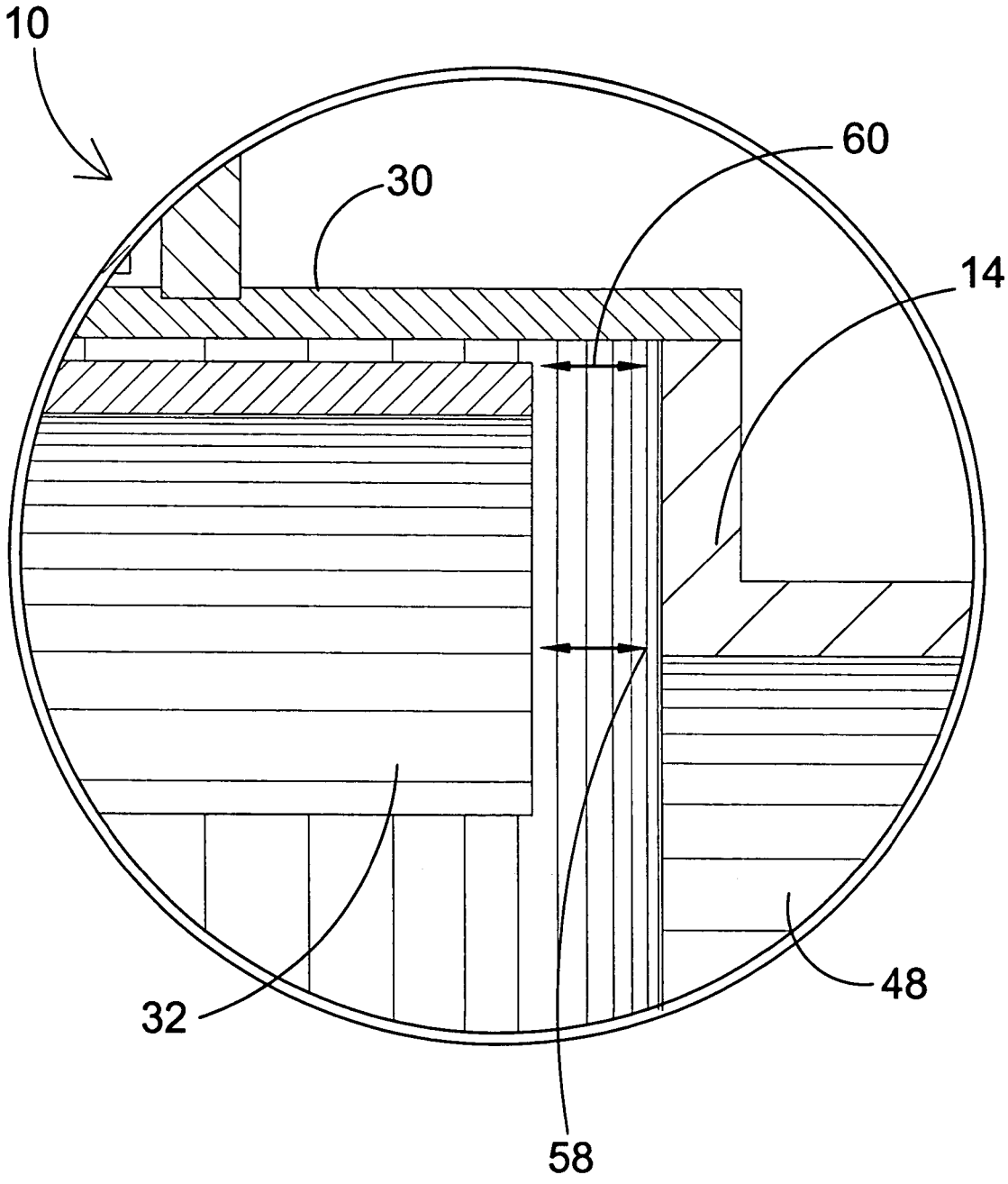
FIG. 8 is a detailed sectional view of the present invention.

Turning to FIG. 8, shown therein is a detailed sectional view of the present invention 10. Shown is the present invention 10 having a distinct effectively sized spacing 60 between the ends of the impeller blades 32 and wall 58 of the housing 14 to allow for a larger space between the components to allow for clearance of larger particulate that may otherwise seize the impeller. Also shown is top plate 30 and outlet 48 complementarily sized as the inlet.

I claim:

1. An apparatus for providing a submersible pump, comprising:

a) a housing having top and bottom ends and a side wall, an inlet being disposed in said bottom, and an outlet being disposed in said side wall of said housing, an inner chamber being disposed in said housing;

b) a plurality of downwardly extending legs being disposed on said bottom of said housing so as to space said inlet away from the supporting ground;

c) a hydraulic motor being disposed on said top of said housing, an output member being rotatably disposed on said hydraulic motor, a motor mount for mounting said motor to said housing, said motor mount having a plurality of first apertures therein;

d) an impeller plate coupled to said output member of said hydraulic motor, said impeller plate having a plurality of second apertures therein, an impeller blade disposed on said impeller plate, said impeller plate and impeller blade being disposed in said inner chamber of said housing so that material can be pumped from said inlet to said outlet of said housing;

e) an air passageway leading from said second apertures of said impeller plate to said first apertures of said motor mount so that trapped air can escape from said inner chamber of said housing to the atmosphere while the apparatus is operating;

f) wherein said motor mount is a plate having top and bottom surfaces and a downwardly extending peripheral edge, wherein said first apertures extend substantially horizontally through said edge of said motor mount to the atmosphere; and g) wherein said top of said housing comprises a top plate, said top plate having top and bottom surfaces wherein said top surface of said top plate is oriented toward said bottom surface of said motor mount, said top plate having a centrally disposed third aperture therein, wherein said output member of said motor extends downwardly through said third aperture so that an opening is formed between said outer surface of said output member and said inner surface of said third aperture so that air can pass through said opening as the air travels from said second apertures to said first apertures to the atmosphere.

2. The apparatus of claim 1, further comprising an impeller splasher being disposed between said top surface of said top plate and said bottom surface of said motor mount so that air can pass between said impeller splasher and said top plate and to said first apertures to the atmosphere.

3. The apparatus of claim 2, wherein said air passes from said inner chamber through said second apertures, then through said opening, then out said first apertures to the atmosphere.

4. The apparatus of claim 3, wherein said impeller plate is substantially horizontally disposed and said impeller blades are substantially vertically disposed, said impeller blades each having an end so that air can pass upwardly through said second apertures in said impeller plate to the atmosphere.

5. The apparatus of claim 4, wherein said ends of said impeller blades are spaced away from the said side of said housing an effective distance to prevent large particles from becoming jammed between said ends of said impeller blades and said side of said housing.

6. The apparatus of claim 5, wherein said impeller blades rotate in generally the horizontal plane, wherein said outlet of said housing extends away from said side of said housing in generally the horizontal plane so that said outlet is disposed laterally away from said ends of said impeller blades so that said blades direct large particles to and through said outlet so that the large particles pass said blades to permit improved operation of the apparatus.

7. The apparatus of claim 6, wherein said legs space said inlet away from the ground an effective distance to prevent blockage of said inlet by large particles of material.

8. The apparatus of claim 7, wherein said inlet is complementarily sized as said outlet to allow particles which pass through said inlet to exit said housing through said outlet.

* * * * *